United States Patent [19]

Kaseman

[11] 4,001,618

[45] Jan. 4, 1977

[54] ELECTRON DISCHARGE IMAGE TUBE WITH ELECTROSTATIC FIELD SHAPING ELECTRODE

[75] Inventor: Paul Warren Kaseman, Lancaster, Pa.

[73] Assignee: RCA Corporation, New York, N.Y.

[22] Filed: Nov. 10, 1975

[21] Appl. No.: 630,652

Related U.S. Application Data

[63] Continuation-in-part of Ser. No. 545,154, Jan. 29, 1975, abandoned.

[52] U.S. Cl. ..... 313/94; 313/99

[51] Int. Cl.[2] ..... H01J 39/04; H01J 31/50

[58] Field of Search ..... 250/213 VT; 313/101, 313/102, 94

[56] References Cited

UNITED STATES PATENTS

| | | | |
|---|---|---|---|
| 2,683,816 | 7/1954 | Bouwers | 250/213 VT |
| 3,333,133 | 7/1967 | Morton et al. | 250/213 VT |
| 3,688,146 | 8/1972 | Bouwers | 313/102 |
| 3,735,139 | 5/1973 | Kalitinsky et al. | 250/213 VT |
| 3,787,745 | 1/1974 | Wulms | 313/102 X |
| 3,801,849 | 4/1974 | Edgecumbe | 313/102 |
| 3,809,889 | 5/1974 | McBroom | 250/213 VT |

*Primary Examiner*—Robert Segal

*Attorney, Agent, or Firm*—Glenn H. Bruestle; Robert J. Boivin

[57] ABSTRACT

An electrostatic field shaping electrode is mounted external to an image intensifier tube in proximate spaced-apart aligned coaxial relation to an insulating envelope wall portion which is exposed to an internal electron accelerating cavity. The field shaping electrode may be employed during the operation of the tube for substantially preventing electron bombardment of the exposed insulating wall portion and for avoiding spurious output signals resulting from the generation of positive ions by that electron bombardment.

9 Claims, 1 Drawing Figure

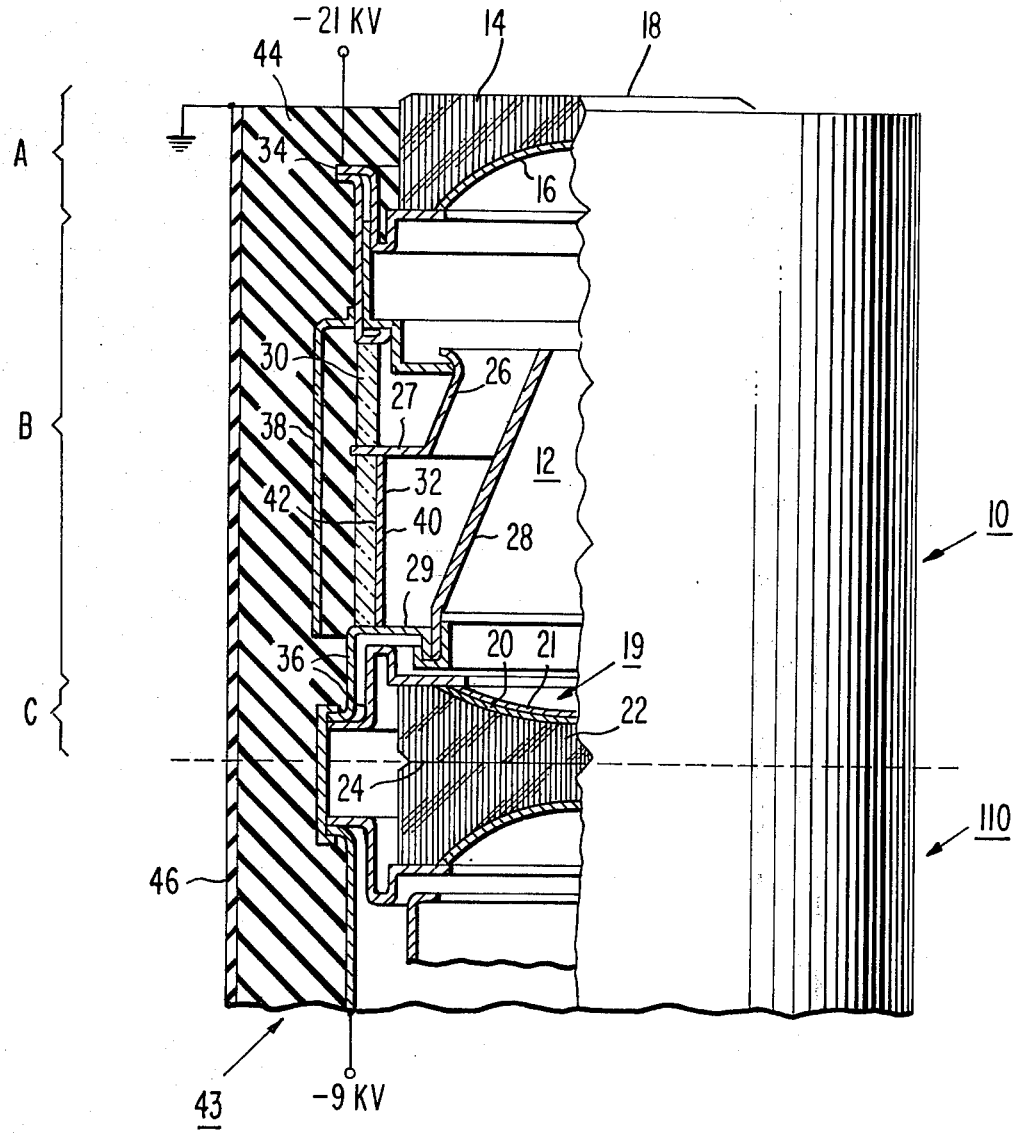
-21 KV
14
18
44
A
34
16
30
26
27
B
38
12
32
42
40
10
28
29
20
21
19
36
C
22
24
110
46
43
-9 KV

ELECTRON DISCHARGE IMAGE TUBE WITH ELECTROSTATIC FIELD SHAPING ELECTRODE

This is a continuation-in-part of application Ser. No. 545,154, filed Jan. 29, 1975, abandoned upon the filing of this application.

BACKGROUND OF THE INVENTION

The invention relates to electron discharge devices and more particularly to image and X-ray intensifier tubes.

Image intensifier tubes are well known in the art of electron discharge devices. Such devices, are for example, described in the book entitled *Photoelectronic Imaging Devices*, Volume 2, edited by L. M. Biberman and S. Nudelman, on pp. 119–165, Plenum Press, N.Y., N.Y. (1971) and in an article entitled "Microchannel Plates Advance Night-Viewing Technology"by Martin J. Needham, in *Electronics* magazine, Sept. 27, 1973, McGraw-Hill, N.Y., N.Y.

Image intensifier tubes are particularly useful for producing on an output screen of the tube an amplified visible image of a radiation pattern which impinges upon an input screen of the same tube. An image intensifier tube generally includes three functional parts: (1) an input screen including a cathode which emits electrons in a density pattern corresponding to the incident radiation pattern, (2) an electron lens system which accelerates the emitted electrons and forms an electron-image of the incident radiation pattern, and (3) an output screen including a phosphor screen placed in the plane of the electron image for converting the electron-image into an output image. Image intensification occurs as a consequence of electrons, which are emitted by the cathode, striking the phosphor screen after being accelerated by the electron lens system at a high voltage (e.g. 8–16 K.V.) with respect to the potential applied to the cathode.

When the output screen of a prior art image intensifier tube is grounded and the tube is surrounded by a grounded shield in the conventional manner generally employed during operation of image tubes, the output image of the operative tube is degraded by spurious light flashes or background signals. However, when the cathode of the input screen is grounded relative to the output screen, the problem is minimized. Unfortunately, such tubes must often be operated in combination with other devices (e.g. silicon intensifier tubes having one or more stages of image intensification, or cascaded image intensifier tubes) where the output screen is substantially at ground potential and where the input screen is at a relatively high negative potential relative thereto, (e.g. −21 K.V.). When the tube is operated in this fashion, portions of the interior wall surfaces of glass or ceramic envelope insulating and support members of the tube are charged positively toward the output screen potential. The charged interior wall surfaces of the envelope attract stray or divergent electrons to the wall causing secondary electrons to be emitted thereby further increasing the positive potential or charge along the interior surface of the envelope. The charged wall surface of the envelope tends to modify the electron accelerating fields within the tube and to divert more electrons to impinge upon the same wall surface portions. As a consequence of the above-noted electron bombardment of the interior envelope wall surface, positive ions are released which are accelerated to impinge upon the cathode of the input screen. The bombardment of the cathode with ions causes the undesirable spurious background electron emission previously described and seriously impairs the signal to noise ratio of the tube.

SUMMARY OF THE INVENTION

In an electron discharge image tube, an electrostatic field shaping electrode is mounted in proximate spaced-apart relation to an insulating wall portion which is exposed to an electron accelerating cavity within the interior of the tube. The field shaping electrode may be employed during the operation of the tube to substantially prevent electron bombardment of the exposed insulating wall portion and to avoid spurious output signals resulting from the generation of positive ions as a consequence of that electron bombardment.

BRIEF DESCRIPTION OF THE DRAWING

The FIGURE of the drawing is a partial axial cutaway view of an image intensifier tube including an image intensifier portion made in accordance with the invention.

DESCRIPTION OF THE PREFERRED EMBODIMENT

Referring to the drawing, there is shown a cascaded or multi-stage image intensifier tube including a first stage consisting of preferred embodiment of an electrostatically focused image intensifier tube 10 and at least one additional stage of image intensification (e.g. another electrostatically focused image intensifier tube 110). Cascaded image intensification devices are well known in the art and are for example, more fully described in the aforementioned book and article.

The tube 10 includes: (1) an input screen portion A, (2) an electrostatic electron lens system and tubular envelope support structure B, and (3) an output screen portion C, hermetically sealed together as an integral tube assembly. The interior of the tube 10 includes an evacuated cavity 12 within which electrons are accelerated.

The input screen portion A includes a light transmissive fiber optic input member 14, and a photocathode 16 along an interior curved surface of that member. The fiber optic input member 14 also includes a substantially flat input surface 18 for receiving an input light radiation signal.

The photocathode 16 may comprise, for example, a thin layer or coating of electron emissive material. A multi-alkali photocathode such as described in U.S. Pat. No. 2,914,690 issued to A. H. Sommer on Nov. 24, 1957 is preferred.

The output screen portion C of the tube 10 includes an output screen 19 along a curved interior surface of a light transmissive fiber optic output member 22. The output screen 19 comprises a layer 20 of phosphor material along the curved interior surface of the fiber optic member 22. Preferably, the output screen also includes a coating 21, formed by evaporation, or other suitable techniques, of aluminum, or other suitable conductive material, for removing the electrical charge developed across the phosphor layer and for also maximizing the efficiency of the phosphor as is well known in the art. A substantially flat output surface 24 extends across an external surface of the fiber optic output member 22, opposite the phosphor screen 19.

The electron lens system and envelope support structure B for the tube 10 depicted in the drawing includes a plurality of electrodes 26 and 28 for accelerating electrons which are emitted from the photocathode 16 during operation of the tube 10 to impinge upon the output screen 19 in a density pattern (i.e. an electron-image) corresponding to the radiation image intensity pattern which passes through the transmissive member 14 and which impinges upon the photocathode 16. The electrode 26 preferably comprises an annular metal focussing grid which is connected during the operation of tube 10 to the same electrical potential to which the photocathode 16 or input screen is connected. The electrode 28 preferably comprises an annular metal anode focussing cone which is connected to the same electrical potential to which the coating 21 of the output screen 19 is connected. Each of the electrodes 26 and 28 is secured to one or more tubular ceramic or glass insulating envelope support members 30 and 32.

The tubular envelope support members 30 and 32 are preferably cylindrical in shape, and are hermetically sealed at opposing ends of the tube 10 to annular sealing flanges 34 and 36 which are in turn, hermetically sealed at their other opposing ends to the fiber optic input and output members 14 and 22, respectively. The tubular envelope support members 30 and 32 are also each hermetically sealed in the central portion of tube 10 to opposing surface portions of a protruding mounting flange 27 of the focussing grid electrode 26 to form a hermetically sealed envelope about the cavity 12 of the tube 10. The focussing cone electrode 28 is secured within cavity 12 to a protruding mounting flange 29 which comprises a portion of one of the sealing flanges 36.

A coating 40 of slightly conductive material of, for example, chromic-oxide is provided along the interior wall surface 42 of the support member 32 which faces the electron accelerating cavity 12. The coating 40 extends substantially along the entire facing internal wall surface 42 between the grid electrode 26 and the focussing cone electrode 28. The electrodes 26 and 28 are electrically connected to the coating 40 at opposing ends of the tubular support member 32. The conductivity of the coating 40 is juditiously selected to provide electric charge dissipation while simultaneously permitting the substantial electrical isolation required between the electrodes 26 and 28, in a manner well known in the art.

A tubular-shaped field shaping electrode 38 is preferably secured external to the tube 10, to one of the sealing flanges 34. As a consequence of being secured to one of the flanges 34, electrode 38 is connected during operation of the tube 10 to the same electrical potential as that applied to the photocathode 16. In the operation of the cascaded image intensifier depicted in the drawing, wherein the tube 10 is cascaded with another substantially similar tube 110, the photocathode 16 and the output screen are connected to suitable negative electrical potentials, such as indicated in the drawing in a manner well known in the art.

The field shaping electrode 38 preferably is cylindrical in shape, and coaxially positioned entirely about, and in proximate spaced-apart relation to the periphery of the support member 32. The spacing between the electrode 38 and the support member 32 must be sufficient to maintain electrical ioslation between that electrode and other electrodes, or portions, of the tube 10 which are connected to dissimilar electrical potentials during the operation of that tube.

A cylindrical housing 43 is provided about the entire cylindrical periphery of the tube 10 and its succeeding cascaded stage 110. The housing 43 includes a sheathing of insulating material 44 such as, for example, rubber for encapsulating and insulating the various electrodes of tubes 10, and 110. Preferably, the encapsulating insulating material 44 of the housing also extends within the spacing which extends between electrode 38 and the envelope support member 32. The housing also includes, along its external periphery, a cylindrical shield 46 capable of electrostatically establishing a ground plane about the periphery of tube 10, electrically isolated from the electrical potentials which may be applied to the electrodes 26, 28, the cathode 16, and the output screen 19. The shield 46 may comprise, for example, a coating of conductive rubber-like material, along the exposed cylindrical surface of the insulating material 44. One suitable material for the coating 46 is "Eccocoat" 258 (a registered trademark) purchased from Emerson & Cuming, Inc. of Canton, Mass. The shield 46 may, alternatively consist of a cylindrical metal sheathing of, for example, aluminum.

During the operation of the tube 10, the field shaping electrode 38 is employed to substantially prevent electron bombardment of the internally exposed wall surface portion 42 or coating 40 by divergent or stray electrons thereby substantially avoiding the emission of undesirable positive ions from that insulating support member or its coating which would otherwise generate spurious electron emission from the photocathode 16 as a consequence of ion acceleration and subsequent ion impingement upon the photocathode 16.

The field shaping electrode 38 must be positioned sufficiently "proximate" to surface 42 of the support member 32, to electrostatically prevent the impingement of stray electrons along that surface or its coating 40 by an application of a suitable electrical potential to the electrode 38 during the operation of the tube 10. The electrode 38 should also be sufficiently removed from the central portion of cavity 12 to avoid substantial modification of electron accelerating fields which accelerate the electron image. However, design modifications of the electron lens system may be employed to avoid such undesired field distortions which might be caused by the presence of the field shaping electrode 38.

In the preferred embodiment, the field shaping electrode 38 is connected to the same electrical potential as that applied to the photocathode 16 of the input screen; however, other electrical potentials may be employed to advantage depending upon the positioning and shape of the field shaping electrode relative to the internal electrostatic electron lens structure of the tube 10.

GENERAL CONSIDERATIONS

While an electrostatically focussed diode-type cascaded image intensifier has been described in detail, the invention relates generally to electron discharge image tubes having numerous dissimilar structural configurations. For example, the light transmissive members 14 and 22 may consist of glass or other transparent material capable of receiving or displaying the desired radiation image. The cathode 16 need not necessarily comprise a photocathode but may comprise an electron emissive material responsive to radiation which is not within the visible light spectrum (e.g. X-Rays). Also, the electron lens system may include magnetic or electrostatic-magnetic techniques well known in the art for accelerating an electron image. Furthermore, multichannel plates may be incorporated within such electron discharge tubes to advantage as described, for example, in the aforementioned article by Needham.

The inventive concept herein disclosed is generally applicable to electron discharge image tubes wherein insulating envelope members of, for example, glass or ceramic are provided having wall surface portions or coatings which are exposed to an interior electron acceleration cavity and wherein stray electrons may be accelerated to impinge along wall portions of those members during the operation of the tubes, to generate positive ions which, in turn, may be accelerated to impinge upon the cathode. The inventive concept is therefore applicable to devices such as "SIT" (silicon intensifier tubes) camera tubes wherein the output screen includes a means of electronic read-out, without the incorporation of a visual display. Thus, an output screen including phosphor material is not required, and any alternative electronic or visual read-out means may be employed to advantage.

What I claim is:

1. An electron discharge tube including:

a. an input portion including an electron emissive cathode capable of emitting electrons as an electron-image in response to a radiation image impinging thereon, b. an output means for receiving said electron-image and for providing a read-out of said electron-image; said output means including an electron-image receiving member in spaced-apart facing relation to said cathode;

c. hermetically sealed envelope means fixably supporting and electrically isolating said cathode and said output means at opposing ends of a tubular envelope portion whereby an electron accelerating cavity extends within the interior of said tubular envelope means between said cathode and said electron-image receiving member;

d. an electron lens system capable of accelerating electrons emitted from said cathode to impinge upon a surface portion of said electron-image receiving member as an electron-image; said electron lens system including at least two electrically isolated electron focussing electrodes secured within said cavity at opposing ends of the tube by said envelope means; said focussing electrodes being electrically isolated from each other by a tubular insulating member of said tubular envelope portion having an interior wall surface facing said cavity within said tube;

e. a tubular electrostatic field shaping electrode extending coaxially about the entire interior wall surface of said tubular insulating member facing said cavity; said field shaping electrode being capable of substantially preventing electron bombardment of said interior wall surface by divergent electrons and of substantially avoiding, during operation of the tube, spurious output signals resulting from the generation of positive ions from that surface as a consequence of such electron bombardment; and f. a housing surrrounding said envelope means; said housing including a conductive shield which coaxially surrounds said envelope means and said field shaping electrode; said shield being capable of establishing a ground plane electrically isolated from electrical potentials which may be applied to said focussing electrodes, field forming electrode, said cathode, and said receiving member.

2. The electron discharge tube of claim 1, wherein said electron-image receiving member includes:

a. a first surface portion with a phosphor material thereon upon which electrons emitted from said cathode may be accelerated to impinge as an electron image; and b. a second surface portion for providing an image read-out of light emitted by said phosphor material as a consequence of electrons impinging thereon.

3. The electron discharge tube of claim 2, wherein said second surface portion of said electron-image receiving member provides a visual image display external to the tube.

4. An electron discharge tube in accordance with claim 2, wherein said wall surface facing said cavity is substantially coated with a chromic-oxide material.

5. An electron discharge tube in accordance with claim 4, wherein said field shaping electrode is electrically connected and physically secured to a metal sealing flange hermetically sealed between said input portion and said tubular insulating member, said sealing flange being electrically connected to said cathode.

6. An electron discharge tube in accordance with claim 5, wherein said cathode comprises a photocathode.

7. An electron discharge tube in accordance with claim 6, wherein said electron-image receiving member additionally comprises a fiber optic member.

8. An electron discharge tube in accordance with claim 7, wherein said tube and said field shaping electrode are cylindrically-shaped.

9. An electron discharge tube in accordance with claim 6, wherein said tubular insulating member consists of a glass or ceramic material.

* * * * *